United States Patent [19]

Bolza-Schünemann

[11] 4,279,410

[45] Jul. 21, 1981

[54] FOLDER FOR A WEB-FED ROTARY PRINTING PRESS

[75] Inventor: Hans B. Bolza-Schünemann, Würzburg, Fed. Rep. of Germany

[73] Assignee: Koenig & Bauer Aktiengesellschaft, Wurzburg, Fed. Rep. of Germany

[21] Appl. No.: 87,847

[22] Filed: Oct. 24, 1979

[30] Foreign Application Priority Data

Oct. 24, 1978 [DE] Fed. Rep. of Germany ..... 2846191

[51] Int. Cl.[3] ..... B41F 13/54; B65H 45/16

[52] U.S. Cl. ..... 270/6; 270/50; 493/417; 493/427; 493/444

[58] Field of Search ..... 270/8, 63–66, 270/67, 70, 76, 77, 80–82, 6, 7, 47–50; 271/82, 182, 230, 245; 198/457, 633

[56] References Cited

U.S. PATENT DOCUMENTS

| | | | |
|---|---|---|---|
| 204,772 | 6/1878 | Spalckhaver | 493/427 |
| 240,235 | 4/1881 | Crowell | 270/77 |
| 3,053,373 | 9/1962 | Cross | 198/633 |
| 3,540,723 | 11/1970 | Bolza-Schuenemann | 270/77 |
| 3,784,187 | 1/1974 | Takayanagi | 270/64 |
| 4,093,206 | 6/1978 | Hartmann | 270/67 |

FOREIGN PATENT DOCUMENTS

| | | | |
|---|---|---|---|
| 1801419 | 9/1970 | Fed. Rep. of Germany . | |
| 1761074 | 8/1974 | Fed. Rep. of Germany | 270/77 |

*Primary Examiner*—Edgar S. Burr
*Assistant Examiner*—A. Heinz
*Attorney, Agent, or Firm*—Jones, Tullar & Cooper

[57] ABSTRACT

A method and apparatus for folding sheet stacks in a web-fed rotary printing press is disclosed. The sheet stacks are severed from groups of paper ribbons and are conveyed by suitable conveying cylinders to spaced folding tables. Each folding table is provided with rotating folding blades and cooperating driving folding roller pairs. Each folding table is further provided with a pulse absorber assembly having a plurality of stop rods or bars which are positioned to contact the leading edge of each group of sheet stacks to halt the motion of the stacks on the folding tables. The halted sheet stacks are then folded. A suitable drive assembly for the pulse absorber is also disclosed.

7 Claims, 5 Drawing Figures

FOLDER FOR A WEB-FED ROTARY PRINTING PRESS

CROSS-REFERENCE TO RELATED APPLICATIONS

The present application is related to U.S. patent application Ser. No. 87,839, filed Oct. 24, 1979, brake for sheet stacks on a folding table, and assigned to a common assignee.

FIELD OF THE INVENTION

The present invention is directed to a method and to apparatus to execute this method to produce folded sheet stacks, a group of paper ribbons comprising a plurality of paper ribbons being cut by an appropriate means into a series of sheet stacks, this series of sheet stacks being subsequently split up into at least two streams of sheet stacks and folded.

DESCRIPTION OF THE PRIOR ART

Folders which cut and fold paper webs brought together from several printing units, and which deliver the folded sheet stacks, for example in the form of newspapers, in a shingled array, are known in different designs. In these devices, two ore more cylinders perform the cutting, the collecting of individual signatures of sheets, if need be, and the cross folding perpendicularly to the machine direction. Cross folding is done at full paper speed either between two cylinders by means of a folding blade and a folding jaw, or by means of a rotating folding blade, which protrudes from the periphery of a rotating cylinder, the tip of the folding blade covering a stationary hypocycloid and pushing the newspaper signature to be cross-folded into two stationary counter-rotating folding rollers. An advantage of the gear folder system is its sturdy design, so that even thick signatures, for example of 144 pages, may still be processed. It is, however, a disadvantage, that folding is done at full paper speed and with an immediate reverse motion of the preceding pinned-up edge of the signature. This imposes speed limits within the system, since otherwise the signatures may be damaged by the so-called "whip effect".

It has been attempted (see German Pat. Nos. 17 61 074 and 18 01 419) to divide the stream of sheet stacks prior to cross-folding them, to decelerate the speed of the sheet stacks by approximately 30%, and to execute the cross fold itself at a relatively slower peripheral speed. Apart from the great technical expenditure required, even in this case it is impossible to remedy one principal disadvantage of the gear folder; that the tip of the folding blade viewed against a resting system, executes only a stationary hypocycloid, usually a three-point star of a straight line. In the rotating cylinder, however, the tip of the folding blade executes a circle. It pricks from below into the sheet stack approximately in the middle of the distance between the pins and the cross fold to be made, and moves at considerable speed and with a scratching effect backward relatively to the paper. Simultaneously, the blade lifts the sheet stack off the quickly rotating cylinder periphery, until the folding rollers engage and execute the cross fold. Thereby, the above-described "whip effect" appears. Furthermore, the immediate reverse motion of the advancing sheet stack edge requires that the pins be withdrawn in time, so that the sheet stack "drifts" more or less free for a short way prior to being cross-folded, that is before the folding rollers "grip". This results in the well-known and disadvantageous dependency on speed, which means that the cross fold given to the sheet stack which is to be folded to a newspaper, will be executed in the same position only if the machine speed remains constant, and must be readjusted by hand or by means of complicated automatic devices to the middle of the sheet stack if the speed is changed.

The jaw folder principle avoids such disadvantages, since there is not considerable relative motion between the sheet stack to be folded and the folding blade. The sheet stack does not "drift" at the moment of folding, since the pins continue holding the stack and open slowly after the folding jaw has been closed. Thus the cross fold is produced at any speed at the same point of the sheet stack. The "whip effect" on the advancing edge of the sheet stack is also less intense, since the change of the direction of motion, although not being neutralized, is not done abruptly, but gradually. It is an advantage that the jaw folding system is thus capable of producing a more precise cross fold at higher speeds without damaging the sheet stack. It is, however, a disadvantage, that there are limitations to the capability of the folding blade-folding jaw system, so that newspapers usually to only 64 pages, or up to a maximum of 80 pages can be cross-folded.

SUMMARY OF THE INVENTION

It is an object of the present invention to provide a method to produce folded sheet stacks, for example newspapers, and to provide apparatus to execute this procedure, thus enabling the cut-off of very thick sheet stacks comprising 144 or more pages from a plurality of paper webs brought together, to cross fold said sheet stacks exactly, independently of the machine speed, and to deliver said sheet stacks, at high speeds. If required, the production of straight run and collected production is enabled.

According to the invention there is provided a procedure to produce folded sheet stacks in a folder of a web-fed rotary printing press, a group of paper ribbons comprising a plurality of paper ribbons being cut by an appropriate means into a series of sheet stacks, and being subsequently split up into at least two streams of sheet stacks. Furthermore, there is provided, according to the invention, a mechanism to execute this procedure, comprising a plurality of formers and a device for bringing the plurality of paper ribbons together into at least one group of paper ribbons, comprising furthermore at least one cross cutting cylinder group to cut the group of paper ribbons into a series of sheet stacks, and one conveyor cylinder equipped with controlled sheet stack conveyor means, for example with pins, which cooperate with at least two take-over cylinders equipped with controlled sheet conveyor means.

The following particular advantages result from the present invention. Since, according to the invention, rotating folding blades and stationary, counter-rotating folding rollers of sturdy design cooperate with each other, cross-folding of very thick sheet stacks into newspapers is enabled as in the well known gear folder. Because the folding blade enters a stationary sheet stack, there is practically no relative motion between the sheet stack and the folding blade as in folding by means of folding jaws, so that, as an advantage, in spite of the gear folding principle used, the cross fold no longer depends upon speed. Cross-folding even the thickest sheet stacks is done at all speeds at the same point of the sheet stack. The folder speed may be considerably higher for two reasons: due to distributing the stream of sheet stacks onto at least two folding tables, the sequence of the sheet stacks is at least divided into halves. Therefore the rotating folding blade performs only half or less the number of strokes, so that the folding-off speed and thus the "whip effect" are divided in half or even to less that that. Additionally, the speed of the advancing edge of the sheet stack is not abruptly changed from the positive to the negative direction of motion, but begins from zero speed so that the "whip effect" is once more diminished to one half. Furthermore, since the position of the folding rollers and the folding blade is at right angles to the direction of motion, the sheet stacks are folded off in the direction of paper motion. Thus, the following sheet stack does not have to wait, as is the case in longitudinal folding mechanisms, for the so-called third fold; i.e. the second longitudinal fold until the entire sheet stack has completely passed through the folding rollers, but may immediately follow the rear edge of the preceding sheet stack. This enables the use of an essential deceleration of the sheet stack before the stack arrives at the stops on the folding table, whereby the kinetic energy of the sheet stacks is once more reduced, when they are braked.

As a further advantage, the thick sheet stacks which have been cross-folded to newspapers, are distributed by the high speed folder in accordance with the present invention onto two or more deliveries, from which result good starting conditions for handling the newspapers in the dispatch room. The quality of the cross fold in the newspaper products is better in spite of high speeds and great numbers of pages, since there is no relative motion nor any scraping caused by the folding blade on the fresh print on the inner newspaper page, and since there is essentially less tearing of the sheets caused by the "whip effect". Furthermore, the novel stop bar systems on the folding tables, which act as impulse absorbers, enable exact stopping of the heavy sheet stacks prior to the cross fold, which is important for high folding precision.

BRIEF DESCRIPTION OF THE DRAWINGS

While the novel features of the folding procedure and the folding mechanism in accordance with the present invention are set forth with particularity in the appended claims, a full and complete understanding of the invention may be had by referring to the detailed description of preferred embodiments as set forth hereinafter and as shown in the accompanying drawings in which:

DESCRIPTION OF PREFERRED EMBODIMENTS

It is known in the art to convey sheet stacks onto a folder, to brake them, and to fold them by means of folding blades and folding rollers. In that case, however, the question is mechanisms which produce a so-called third fold, or second longitudinal fold. The sections which arrive on the folding table have been cross folded before in a jaw folding or gear folding system, including all the restrictions for the cross fold as mentioned above. The folding mechanism in accordance with the present invention uses, however, folding tables the folding rollers and folding blades of which are not disposed in the paper direction, but are turned 90°, and the cross fold which until now had its problems, is no longer produced in the moving newspaper, by means of folding cylinders but on resting signatures on folding tables in accordance with the present invention.

Figure 1:
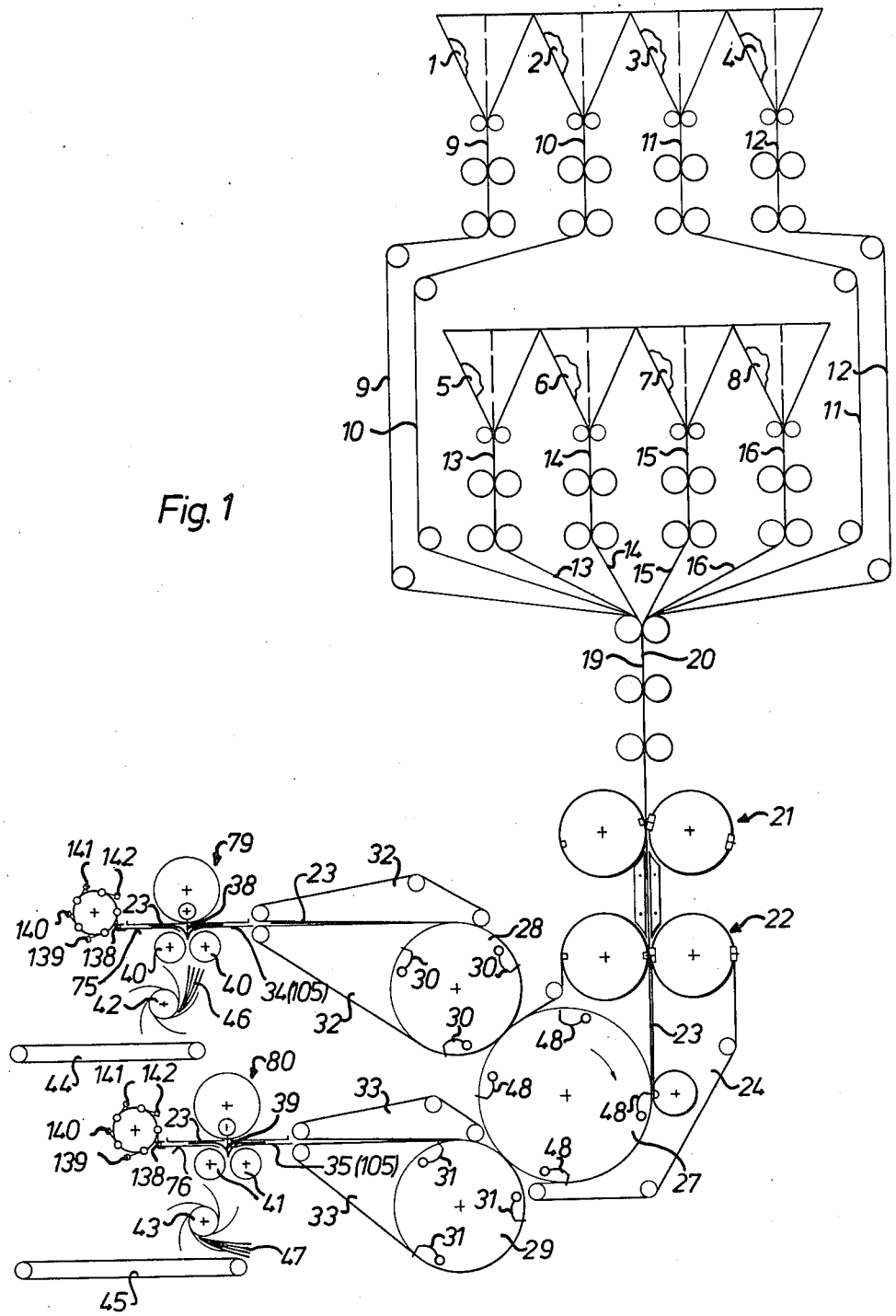
FIG. 1 is a schematic cross-sectional view of a folder for the production of newspapers comprising 160 pages in straight run production onto either delivery, with horizontally disposed folding tables in accordance with the present invention.

As may be seen in FIG. 1, for the production of newspapers of 160 pages in straight run production, ten paper webs come from printing units of eight plates' width (not shown in the drawing) and are conveyed over eight formers 1–8 in a balloon disposition. Each four longitudinally folded paper ribbons 9, 10, 13, 14 and 11, 12, 15, 16 are joined below the formers 5, 6, 7, 8 to form paper ribbon groups 19, 20 each, the thickness of each of the paper ribbon groups being that of 40 paper thicknesses. These groups of paper ribbons 19, 20 are conveyed in a straight line to one driven cross-cutting cylinder group 21 or 22 which are equipped with staggered cutting knives. When the groups of paper ribbons 19, 20 have been cut to sheet stacks 23, tape guides 24 running in gaps between the cutting knives of the cross-cutting cylinder group 22 convey the sheet stacks 23 to a four-field pin collecting cylinder 27, which joins the sheet stacks 23 by pinning them up. The sheet stacks 23 are then alternately conveyed to take-over conveying cylinders 28 and 29. Take-over cylinders 28, 29 are equipped with pluralities of sets of pins 30 or 31, respectively, which are capable of being controlled, and which convey sheet stacks 23, which have not yet been cross-folded, to a folding table portion 34 or 35, which in this case are horizontally disposed of the cross folding device 79 or 80, respectively, the sheet stacks 23 stopping against stop rods 138–142 shown, as an example, in FIG. 1 and described in detail hereinafter. By means of rotating folding blades 38, 39, the sheet stacks 23 which are at rest, are pushed into driven folding roller pairs 40 or 41, so that they are cross folded from their resting position. Each cross folding system 34, 38, 40, or 35, 39, 41 respectively, runs at half the number of strokes in relation to the number of cross folded sheet stacks 23. Each sheet stack 23 may, after having left the pin cylinder 27 and prior to being pushed at the stop rods 138–142, be slowed down in its running speed in such a way, that the front edge of the next following sheet stack 23 on that folding table does not quite reach the rear edge of the preceding sheet stack 23. One delivery fan each 42, 43 with adjoining delivery tapes 44, 45 is disposed below the pairs of folding rollers 40 and 41. It is furthermore possible to install pairs of folding rollers (not shown in the drawing) below the pairs of folding rollers 40 and 41 in order to slow down the speed at which the signatures 46, 47 are placed in the delivery fans 42 and 43.

Modifications to the folder described above and shown in FIG. 1 are practicable, for example; all the longitudinally folded paper ribbons 9–16 may be joined below the formers 5–8 to two groups of paper ribbons and cross-cut in this way, instead of one group of paper ribbons, since a plurality of cross cutting cylinder groups 21, 22 are provided. Instead of the controlled pins 48, 30, 31 on the cylinders 27, 28, 29, it is also possible to provide grippers, if the cylinder peripheries are accordingly somewhat enlarged. It is an advantage that in this case the problems with respect to pinning-up are avoided as well as the production of paper dust caused by that pinning-up.

Figure 2:
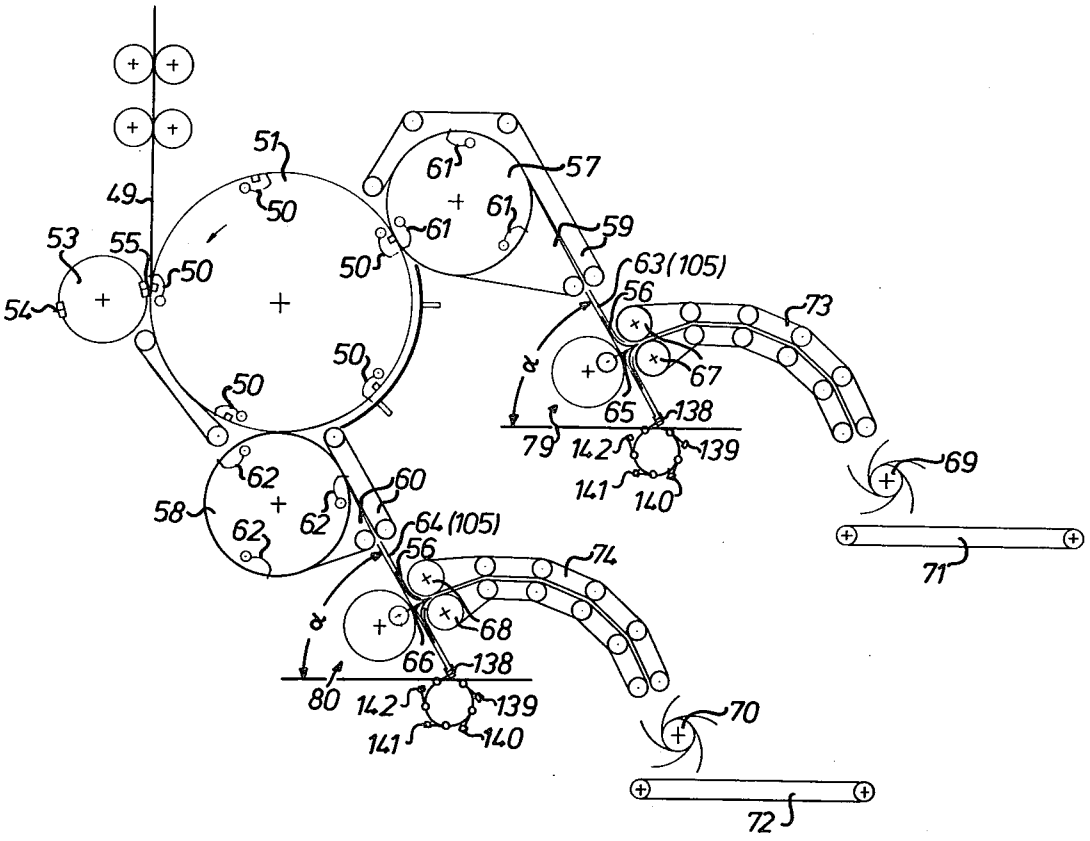
FIG. 2 is a schematic cross-sectional view of a folder for the production of newspapers in collect run or straight run production with inclined folding tables in accordance with the present invention.

As may be seen in FIG. 2, ten paper webs which run over three formers (not shown in the drawing) are then joined to form a group of paper ribbons 49 and are seized by controlled pins provided on a five-field cutting groove and collecting cylinder 51. Cross-cutting the paper ribbon group 49 into sheet stacks 56 is done by means of a cutting cylinder 53 equipped with two cutting knives 54, 55 which operate centrically or, in collect run production; eccentrically. In straight run production, the pins 50 deliver the sheet stacks 56 alternately to controllable pins 61 or 62, which are provided on take-over cylinders 57 or 58. Tape guides 59 or 60 convey the sheet stacks 56, which have not yet been folded, alternately onto folding tables 63 or 64 which are both disposed at an angle $\alpha$ to the horizontal line. These sheet stacks 56 are conveyed to stop rods 138–142 whose operation will be described in detail with respect to FIG. 4 and FIG. 5. Rotating folding blades 65, 66 of the cross folding devices 79 and 80 push the sheet stacks 56 for cross folding from their resting position on the folding tables 63 or 64 into pairs of folding rollers 67, 68, which are disposed crosswise to the direction of motion of the sheet stacks 56, and then to the delivery fans 69 and 70. The conveyance of the cross folded sheet stacks 56 from the folding roller pairs 67 or 68 to the delivery fans 69 or 70 is done by means of driven tape guides 73, 74. The alternating opening of the pins 50 provided on the cutting groove and collecting cylinder 51, or of the pins 61, 62 provided on the take-over cylinders 57, 58 may, for example, be done by means of a control mechanism as described in German Pat. No. 18 01 419, so that the straight run production is distributed to both delivery fans 69, 70 or to the delivery tapes 71, 72. In collect run, every first sheet signature runs one time around the cutting groove and collecting cylinder 51 and is then joined with a second sheet signature, before the pins 50 deliver the now collected sheet stack 56 either onto the take-over cylinder 57 or alternatively onto the take-over cylinder 58. It is also possible to split the sheet stacks by collecting them alternately onto both take-over cylinders 57 and 58. The rotating folding blades 65, 66 run each at half the stroke number of the the total production of sheet stacks 56. In the case of simultaneous collecting and splitting-up, a quarter of the stroke number is sufficient.

Figure 3:
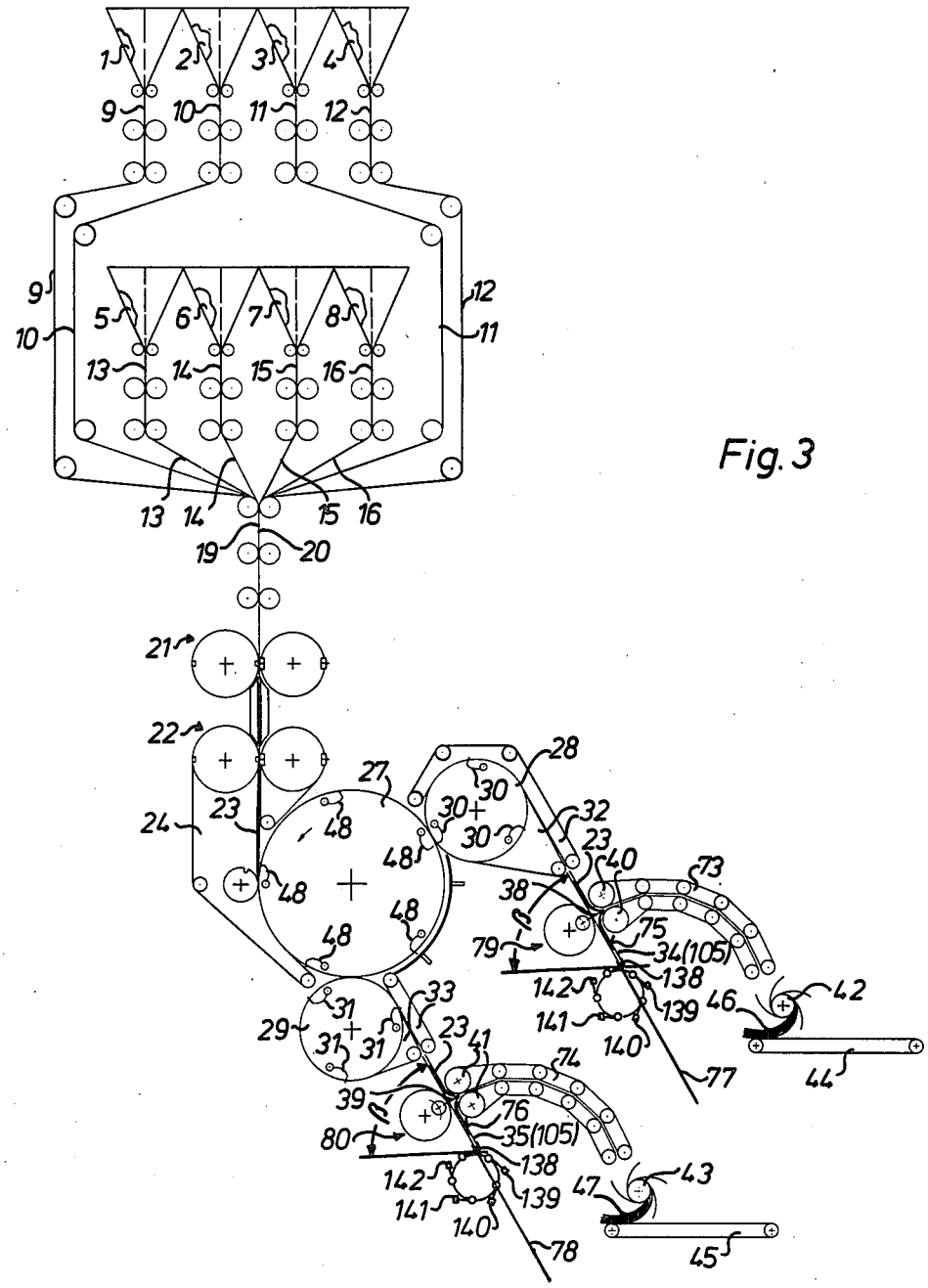
FIG. 3 is a schematic cross-sectional view of a folder for the production of newspapers with 160 pages in straight run production onto either delivery, as shown in FIG. 1, with inclined folding tables in accordance with the present invention.

The folder shown in FIG. 3 is identical with the folder described with respect to FIG. 1, as regards its function. Therefore, the description with respect to FIG. 1 is valid for this folder also. Identical parts are marked with identical numerals. There is, however, a difference between the folders of FIG. 1 and FIG. 3, namely in that the folding tables 34 and 35 of FIG. 3 are not disposed horizontally, but are at an angle $\beta$ to the horizontal line. It is an advantage that the surfaces of the folding tables 75 and 76 of the cross-folding mechanism 79, 80 lie on a tangent 77 or 78 on the periphery of the take-over cylinders 28, 29.

Conveyance of the cross folded sheet stacks 23 from the folding roller pairs 40 or 41 to the delivery fans 42 or 43 is done by means of tape guides 73 or 74. These tape guides 73, 74 may run at a lower tape speed to enable slowing the signatures down. Furthermore, the gap in the folding table over the folding rollers may temporarily be bridged by appropriate means (not shown in the drawing), so as to guarantee a trouble-free introduction of the sheet stacks above this gap.

Figure 4:
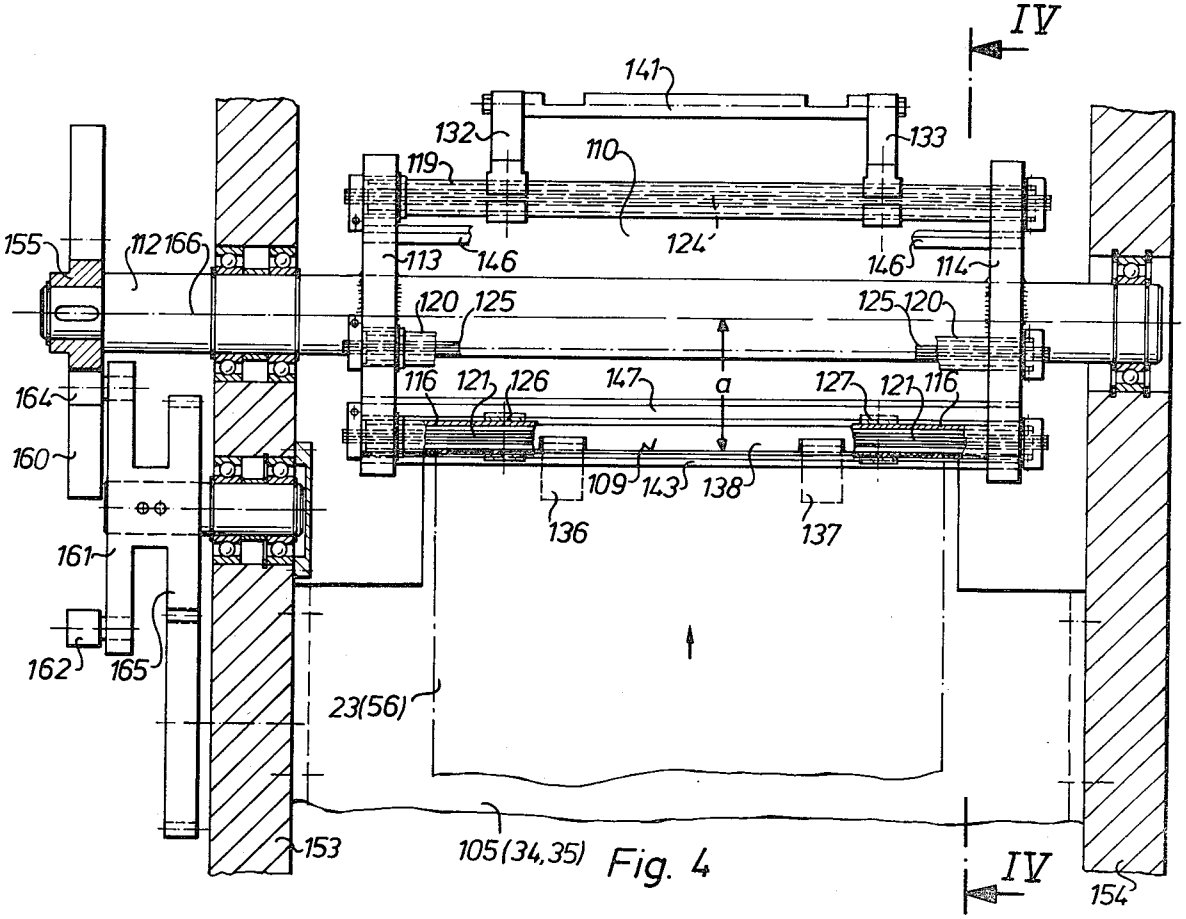
FIG. 4 is a plan view, partly in section, of a sheet stack brake drum with hinged, pulled-out stop rod and drive for the drum in accordance with the present invention.
Figure 5:
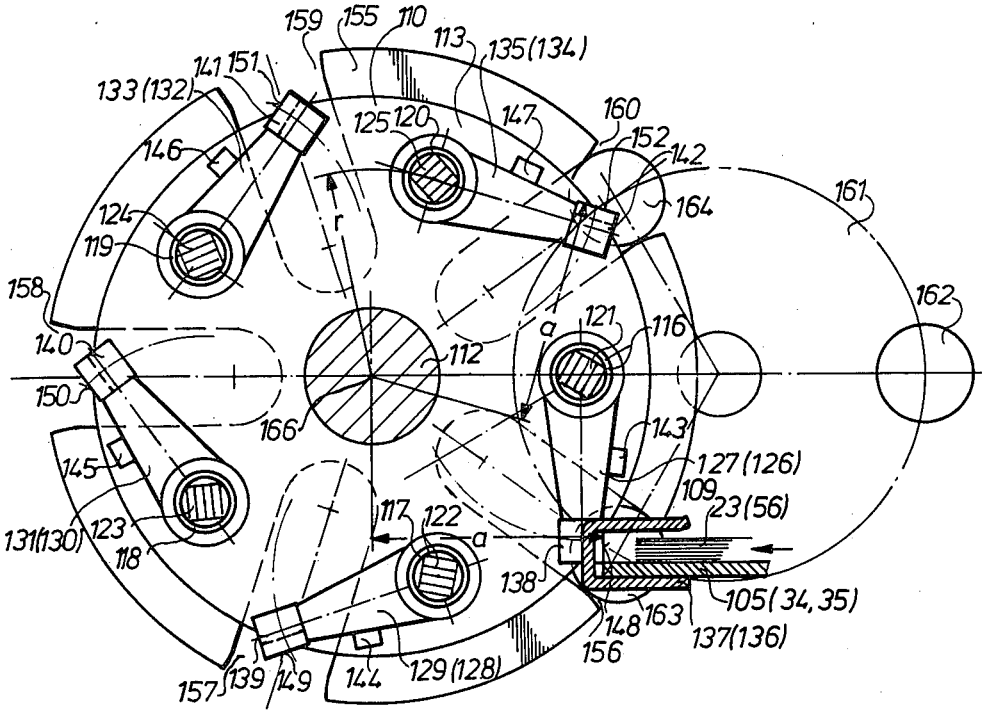
FIG. 5 is a sectional schematic view of the sheet stack brake drum taken along line IV—IV of FIG. 4 without side frame in accordance with the present invention.

In FIGS. 4 and 5 there is shown a mechanism for bringing the heavy, rapidly moved sheet stacks 23 and 56 exactly and promptly into a resting position. For this purpose, a pulse absorber is used in an advantageous manner, which makes it possible for the sheet stacks 23 or 56 to come to rest free of energy always at the same place and at any speed, when they push, with varying force, on the movable masses or stop rods 138–142. A folding blade enters each sheet stack 23 or 56 at the same point, so that within the whole speed range, a very exact fold at the highest possible speed is guaranteed. Even very heavy sheet stacks 23 or 56 can be braked without any problem. Preferably the suitable pulse absorbing mass 138–142 corresponds approximately to the mass or to the weight of the sheet stacks 23 or 56.

The sheet stacks 23 or 56 are conveyed by means of driven tape guides 32 or 33 to a folding table 105 each of which is equipped with folding rollers provided below the folding table 105, and with a rotating folding blade. Every sheet stack 23 or 56 pushes at one of the five stop rods 138–142, which are movably supported in a brake drum 110 and are pressed into a resting position on the periphery of the brake drum 110 by means of springs or torsion bars 121–125. The stop rods 138–142 are disposed at right angles to the direction of motion of the sheet stacks 23 or 56 respectively, and in such a manner that the sheet stacks 23 or 56 push with their face 109 at the stop rods 138–142 and are capable of moving said rods from their resting position. In order to avoid the sheet stacks 23 or 56 being moved beyond the folding table 105, or opening at their face 109, U-shaped stops 136, 137 are fixed at the end of the folding table 105.

The brake drum 110 is moved by means of an intermittent drive, for example a Maltese cross gear in such a manner that the brake drum 110 stops instantaneously for the period in which a sheet stack 23 or 56 pushes at a movable stop rod 138–142. After this push, the stop rod 138–142 moves against the increasing spring pressure into the center of the brake drum 110, while the brake drum 110 is simultaneously rotated incrementally to the following resting position. Therefore, a pushed mass, for example in the form of stops rods 138–142, is immediately moved out of the reach of the sheet stack 23 or 56, and is thus not capable of touching and displacing said sheet stacks 23 or 56 again when it swings back. Furthermore, it is an advantage that the pushed mass 138–142 has sufficient time to get to a relative rest position with respect to the brake drum 110 again, since four further sheet stacks 23 or 56 are being stopped by other identical movable masses 138–142. Thus, very high operating speeds of the whole system can be obtained.

FIGS. 4 and 5 show a preferred cage-like structure of the brake drum 110. A shaft 112 is rotated by steps of one-fifth rotation each. On shaft 112, two side flanges 113, 114 each provided with five borings or notches are disposed on a circle with radius "r". Hollow shafts 116, 117, 118, 119, 120 with internal torsion bars 121, 122, 123, 124, 125 are rotatably supported in these borings. Hollow shafts 116–120 carry light supporting arms 126–135, the supporting arms carrying the stop rods 138–142. Stops 143–147 provided on the side flanges 113, 114 limit the oscillating stroke of the stop rods 138–142. The arriving sheet stack 23 or 56 pushes, in accordance with its kinetic energy, more or less violently at the stop rods 138–142 and is caused to rest, free from energy, on the folding table 105. FIGS. 4 and 5 show a cross sectional view of the brake drum 110. They show the shaft 112 supported in side frames 153, 154 and equipped with the side flanges 113, 114 and the rotatable hollow shafts 116–120. The supporting arms 126, 127; 128, 129; 130, 131; 132, 133; and 134, 135 support the stop rods 138–142 as mass pendula. The stop areas 148–152 on the stop rods 138–142 are spaced in the resting position at a distance "a" from an axis of rotation 166 of the brake drum 10.

FIGS. 4 and 5 also show a drive system for incrementally rotating the brake drum 110, which is very simple in spite of its high efficiency of, for example, 45,000 stoppages per hour. A Maltest cross gear 155, having five slots 156–160, is secured on the shaft 112. A driving plate 161, supported in the side frame 153 carries three driving rollers 162, 163, 164 staggered at 120° from each other, which enter into the slots 156–160. The remaining angle of rotation left between the slots of ±6° is covered by circular arc-shaped extensions of the slots 156–160, so that the driving rollers 162–164 serve also as mutually acting blocking rollers during the short rest of the Maltese cross gear 155. An identical driving system is described in detail in German Pat. No. 17 61 074, serving, however, another purpose. The power input on the Maltese cross gear 155, 161 is done by means of a gear 165, which is in functional conjunction with a drive of the folder. In this case, also a side flange 113, 114 may be designed as a Maltese cross gear 155.

It is possible to install more or less than five movable masses 138–142 in the brake drum 110. It is also not required that these movable masses be moved as pendula around a synchronizing center of rotation, but they may be designed as masses running in straight-line guides. Instead of the torsion bars 121–125, other immobilizing means and supplementary shock absorbers may be provided. The pulse absorbing drum 110 is not restricted to its application in the second longitudinal fold in a rotary folder, but it may be used in general where rhythmically conveyed sheet stacks, or books, or the like are to be abruptly braked.

While preferred embodiments of a folder for a web-fed rotaty printing press in accordance with the present invention have been set forth fully and completely hereinabove, it will be obvious to one of skill in the art that changes can be made, for example, as set forth in the preceding paragraph, without departing from the true spirit and scope of the present invention and that accordingly, the invention is to be limited only by the appended claims.

What is claimed is:

1. An apparatus for producing cross folded sheet stacks, said apparatus comprising:

a plurality of formers having means to bring a plurality of paper ribbons together to form at least one group of paper ribbons;

at least one cross cutting cylinder group to cut said group of paper ribbons into a series of said sheet stacks;

a collecting cylinder equipped with controlled sheet stack gripping means to receive said sheet stacks from said cross cutting cylinder group;

at least two take-over cylinders equipped with controlled sheet stack conveyor means to receive said sheet stacks from said collecting cylinder;

at least one sheet stack conveying means for receiving said sheet stacks from said take-over cylinders;

at least one cross folding means for cross folding said sheet stacks at right angles to their direction of motion at a folding table; and at least one sheet stack braking device to stop said sheet stacks during said cross folding, said braking device being disposed after said cross folding means with respect to the direction of movement of the stacks, said sheet stack braking device having a plurality of resiliently supported stop rods, a leading edge portion of each of said sheet stacks contacting one of said stop rods to move said rod from a rest position; a rotatable brake drum means mounting each said rod on said brake drum for rotation therewith to slow-down and stop the forward movement of the sheet stacks on said folding table; means for resiliently biasing each said rod to allow it to move a distance with a stack of sheets wherein Kinetic energy is transferred from the braked stack of sheets to the rod and biasing means; and means for intermittently rotating said brake drum to position succeeding ones of said stop rods for contact by said leading edge of succeeding sheet stacks whereby each said stack is braked by engagement with one of said resilient stop rods.

2. The apparatus of claim 1 wherein said collecting cylinder can be alternately switched between straight run and collect run production.

3. The apparatus of claim 1 wherein said means for intermittently rotating said brake drum is a Maltese cross gear secured to said brake drum and cooperating with a driving plate carrying three driving rollers staggered at 120°.

4. The apparatus of claim 3 wherein said Maltese cross gear has five slots.

5. The apparatus of claim 1 wherein said rotatable brake drum carries five stop rods.

6. The apparatus of claim 1 wherein said folding table is generally horizontal.

7. The apparatus of claim 1 wherein said folding table is inclined at an angle to the horizontal.

* * * * *